US010352654B2

(12) United States Patent
Costet et al.

(10) Patent No.: US 10,352,654 B2
(45) Date of Patent: Jul. 16, 2019

(54) FIREARM WITH INTERCHANGEABLE SIGHTING DEVICE SYSTEM

(71) Applicant: FN America, LLC, McLean, VA (US)

(72) Inventors: Olivier Holger Costet, Columbia, SC (US); Luke Randel Howlett, Camden, SC (US)

(73) Assignee: F.N. Herstal, S.A., Herstal (BE)

( * ) Notice: Subject to any disclaimer, the term of this patent is extended or adjusted under 35 U.S.C. 154(b) by 0 days.

(21) Appl. No.: 15/969,656

(22) Filed: May 2, 2018

(65) Prior Publication Data

US 2019/0049217 A1 Feb. 14, 2019

Related U.S. Application Data

(60) Provisional application No. 62/545,122, filed on Aug. 14, 2017.

(51) Int. Cl.

| | |
|---|---|
| ***F41G 11/00*** | (2006.01) |
| ***F41G 1/17*** | (2006.01) |
| ***F41G 1/26*** | (2006.01) |
| ***F41G 1/16*** | (2006.01) |
| *F41C 3/00* | (2006.01) |
| *F41G 1/30* | (2006.01) |

(52) U.S. Cl.

CPC ..... *F41G 1/17* (2013.01); *F41G 1/16* (2013.01); *F41G 1/26* (2013.01); *F41G 11/001* (2013.01); *F41C 3/00* (2013.01); *F41G 1/30* (2013.01)

(58) Field of Classification Search

CPC ..... F41G 1/16; F41G 1/06; F41G 1/18; F41G 11/001–11/005; F41G 1/30; F41G 1/17; F41G 1/26

USPC ... 42/111–117, 124–127, 135–137, 139, 148

See application file for complete search history.

(56) References Cited

U.S. PATENT DOCUMENTS

| | | | | |
|---|---|---|---|---|
| 5,467,552 | A * | 11/1995 | Cupp | F41G 1/26 42/125 |
| 7,296,376 | B2 | 11/2007 | Kidd | |
| 7,526,890 | B1 | 5/2009 | Da Keng et al. | |
| 7,765,731 | B1 * | 8/2010 | Liebig | F41G 1/01 42/113 |
| 8,448,373 | B2 | 5/2013 | Matthews et al. | |
| 8,584,390 | B1 * | 11/2013 | Fraher | F41C 23/10 42/71.02 |

(Continued)

FOREIGN PATENT DOCUMENTS

| | | |
|---|---|---|
| WO | 1998013717 A3 | 4/1998 |
| WO | 2013003873 A1 | 1/2013 |

*Primary Examiner* — Jonathan C Weber

(74) *Attorney, Agent, or Firm* — Nexsen Pruet, LLC; Michael A. Mann; Todd A. Serbin

(57) ABSTRACT

A firearm having a top surface to which an optical sight is to be attached having a first portion and an adjacent second portion stepped down from the first portion. An adaptor plate is received in the second portion, its shape corresponding to the second portion to properly orient the adaptor plate. The bottom of the second portion and the underside of the adaptor plate having features to receive a spring. An optical sight is attached with at least one fastener to the first portion and directly to the slide of the pistol with a part of the optical sight cantilevered over the second portion and on the adaptor plate. The upper surface of the adaptor plate has a topography that corresponds to a complimentary topography on the underside of that portion of the optical sight.

20 Claims, 6 Drawing Sheets

(56) References Cited

U.S. PATENT DOCUMENTS

| | | | | |
|---|---|---|---|---|
| 8,893,422 | B2 * | 11/2014 | Wolf | F41A 3/12 42/111 |
| 9,062,936 | B2 | 6/2015 | Zimmer | |
| 9,267,759 | B2 | 2/2016 | Speroni | |
| 9,410,770 | B2 | 8/2016 | Zimmer | |
| 9,453,706 | B1 | 9/2016 | Crispin | |
| 9,506,726 | B2 * | 11/2016 | Wolf | F41G 1/26 |
| 10,024,628 | B2 * | 7/2018 | Toner | F41G 1/16 |
| 10,036,613 | B2 * | 7/2018 | Huff | F41G 11/001 |
| 2008/0216379 | A1 * | 9/2008 | Javorsky | F41G 1/12 42/115 |
| 2011/0283589 | A1 * | 11/2011 | Matthews | F41A 33/00 42/113 |
| 2013/0283660 | A1 * | 10/2013 | Matthews | F41G 1/30 42/113 |
| 2014/0053445 | A1 * | 2/2014 | Wolf | F41A 3/12 42/14 |
| 2014/0230305 | A1 * | 8/2014 | Zimmer | F41G 11/001 42/111 |
| 2015/0241175 | A1 * | 8/2015 | Wolf | F41G 11/005 42/124 |
| 2016/0334193 | A1 | 11/2016 | Zimmer | |
| 2017/0082402 | A1 | 3/2017 | Zimmer | |

* cited by examiner

FIREARM WITH INTERCHANGEABLE SIGHTING DEVICE SYSTEM

RELATED APPLICATIONS

This application claims the benefit of priority under 35 USC § 119(e) of U.S. Provisional Patent Application No. 62/545,122 filed on Aug. 14, 2017, the contents of which are incorporated herein by reference in their entirety.

TECHNOLOGY FIELD

This disclosure relates to firearms and their sights and, more specifically, to firearms to which optical sights may be attached.

BACKGROUND

Firearms are usually equipped with fixed sights, typically a front sight and a rear sight. In handguns, such as auto-loading pistols, a slide runs from the front of the pistol over the barrel to the back of the pistol over the receiver, and it reciprocates when the gun fires, sliding rearward just after firing the gun and then sliding forward to chamber a new round of ammunition and reset the fire control system.

In recent years, optical gun sights have been improved through developments such as reductions in their size, weight, and improved energy efficiency to the point that it is now practical to affix them to the slide of auto-loading pistols in addition to other firearm types. The ability of the user to hit a target depends in part on the user's ability to aim accurately. An improved gun sight may improve the user's ability to aim when the gun is fired.

These improved gun sights include reflex or holographic sights. They use lenses and projected light to produce a red dot or other aiming indicator superimposed on an image of the target visible in the optical viewfinder that indicates where a bullet would strike the target if the gun fires at that moment. The target does not have a red dot on it; the sight makes it appear so in the viewfinder.

Optical sights may be used with pistols by mounting them to the slide. Because the slide reciprocates after firing, and does so rapidly, the attachment of the optical sight to the slide should be secure. Some handguns have an optical sight in place of the rear sight and the integral nature of that type of attachment helps to assure a secure connection.

Some handguns provide a place for the attachment of a particular optical sight. Here, too, the type of attachment, although designed for removability, is still relatively secure because the gun receives a particular, removable optical sight.

Also, a gunsmith may be hired to modify an existing pistol so that it will receive a particular optical sight.

As improvements continue in optical sight technology, and better sights become available, there is a need for a system that enables owners to mount any improved optical sights that may become available from different manufacturers to the user's pistol and do so securely.

One common solution for this need is the use of a "cut" or flat area formed on the top surface of the slide of a pistol that receives an adaptor plate. An adaptor plate corresponds to an optical sight, and provides the interface for the gun to receive that optical sight. A different adaptor plate is required to adapt a different optical sight to that gun. Screws attach the optical sight to the adaptor plate and to the slide below it. This method offers versatility but lacks the security of a direct mounting solution and places the optical sight higher above the slide than a direct mounting solution making co-witness with the existing sights difficult.

A better way of removably attaching an after-market optical sight to the slides of automatic pistols would be an advantage.

SUMMARY

According to its major aspects and briefly recited, herein is disclosed a system for enabling an optical sight to be removably attached to the slide of a pistol or other firearm. The present system provides the versatility of the adaptor plate without losing the security and low positioning of a direct mounting solution. This versatility can allow for the continued use of the existing sights with alternate sighting systems.

A feature of the disclosure is a pistol slide with a top surface having a first portion and a second portion. The first and second portions are defined by a step down from the first portion to the second portion. Adaptor plates are provided as part of the system. Any one of the adaptor plates will fit into the second portion. The adaptor plate has a shape that compliments the shape of the second portion so that the adaptor plate will fit in the second portion in a predetermined way and orientation. The adaptor plate also has a first configuration on its upper surface that matches a second configuration on the bottom surface of a specific optical sight. To use a different optical sight, a different adaptor plate is used which corresponds to the different optical sight. The optical sight is attached directly, and in contact with, the first portion of the slide using fasteners. A portion of the optical sight extends over the second portion thereby cantilevering that portion of the optical sight which contains a second configuration on its bottom surface to engage a complimentary first configuration of the top surface of the adaptor plate when that adaptor plate is positioned in the second portion of the top surface of the slide. If a different optical sight is used, a corresponding adaptor plate can be matched to the slide of the pistol so that the bottom of the different optical sight chosen can mate with its corresponding adaptor plate and be secured directly to the pistol.

Another feature of the disclosure is that the first portion of said top surface is larger than said second portion.

Still another feature of the disclosure is that the first portion has at least one attachment point and the optical sight has at least one corresponding attachment point so at least one fastener affixes the optical sight directly to the first portion of the top surface of the firearm and not through an adaptor plate.

A feature of the disclosure is that the adaptor plate has a thickness not thicker than the height of the step between the second portion and the first portion, and therefore permits a spring to be placed between the second portion and the bottom of the adaptor plate. The bottom surface of the adaptor plate or the surface of the second portion or both may have complimentary features formed therein to receive and hold a spring.

A feature of the disclosure is that the first portion may have a shape that compliments the shape of the optical sight to be attached to it, such as a curved or flat shape.

Another feature of the disclosure is that the first configuration of the top surface of the adaptor plate may comprise at least one mounting feature.

These and other features and their advantages will become apparent to those skilled in firearms from a careful reading of the Detailed Description accompanied by the following drawings.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

In the figures.

DETAILED DESCRIPTION

Figure 1:
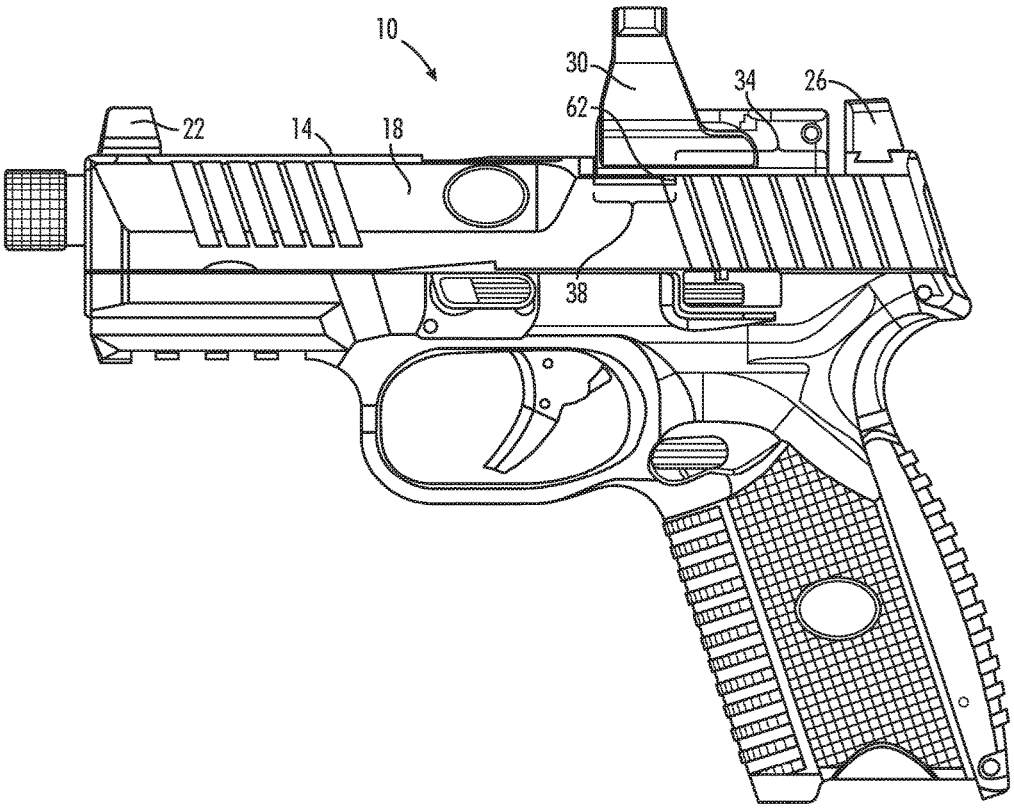
FIG. 1 is a left side view the auto-loading pistol of FIG. 1, according to an aspect of the disclosure.

Herein disclosed is a firearm adapted to receive any one of several, different optical sights, which can be attached interchangeably and directly the top surface of the firearm.

Referring now to the figures, the firearm may be a pistol 10, as shown, or other type of firearm. An optical sight 30 is a sighting device for use in aiming pistol 10.

Optical sight 30 is attached directly to the top surface 14 of pistol 10 for a more secure attachment than when optical sight 30 is fastened to the top surface of pistol 10 through an adaptor plate. As disclosed herein, an adaptor plate 58 is selected for optical sight 30 that allows direct attachment of optical sight 30 to top surface 14, and, with the use of adaptor plate 58, will align that particular optical sight 30 with pistol 10. In addition, optical sight 30 is attached in a way that may enable the pre-existing iron sights on pistol 10 and optical sight 30 to be co-witnessing. Co-witnessing means that rear sight 26, when aligned with the front sight 22, aligns with optical sight 30 to indicate where the bullet will strike the target. Co-witnessing has the effect of corroborating the user's aim.

Pistol 10, as shown in FIG. 1, when held in an orientation by a user for firing, includes slide 18 having top surface 14, and which slide 18 is reciprocating. The forward end of slide 18, that is, the end away from the user holding pistol 10 in hand as if to shoot, carries front sight 22; the rearward end of slide 18 carries rear sight 26. Front sight 22 and rear sight 26 are thus on top surface 14 of slide 18 of pistol 10. Optical sight 30 is attached to top surface 14 of slide 18, between front sight 22 and rear sight 26. Accordingly, rear sight 26 need not be removed to install optical sight 30.

Figure 2:
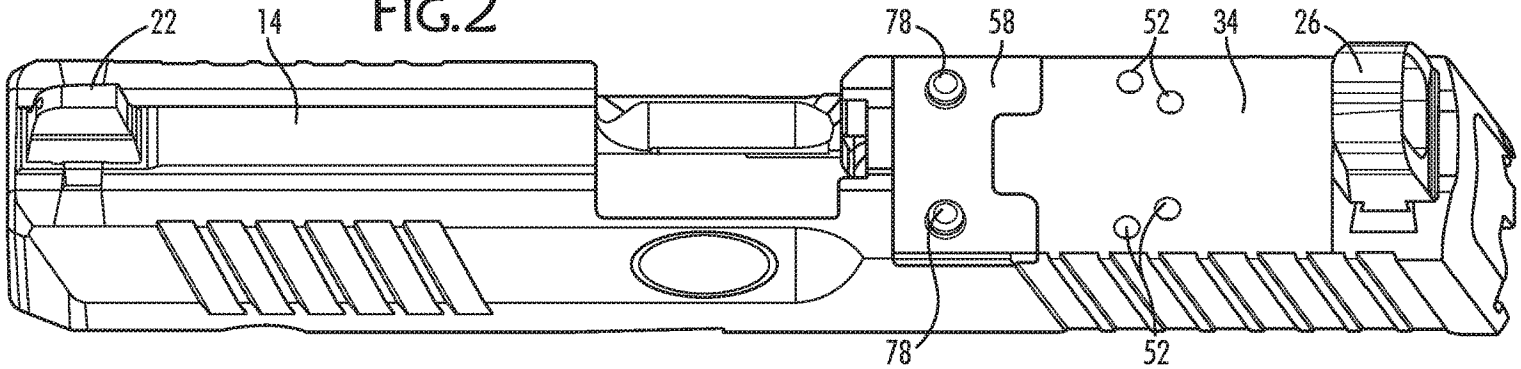
FIG. 2 is an upper left perspective view of the slide shown in FIG. 1 with the optical sight removed to show the first portion and the second portion of the slide with the adaptor plate positioned in the second portion, according to an aspect of the disclosure.
Figure 3:
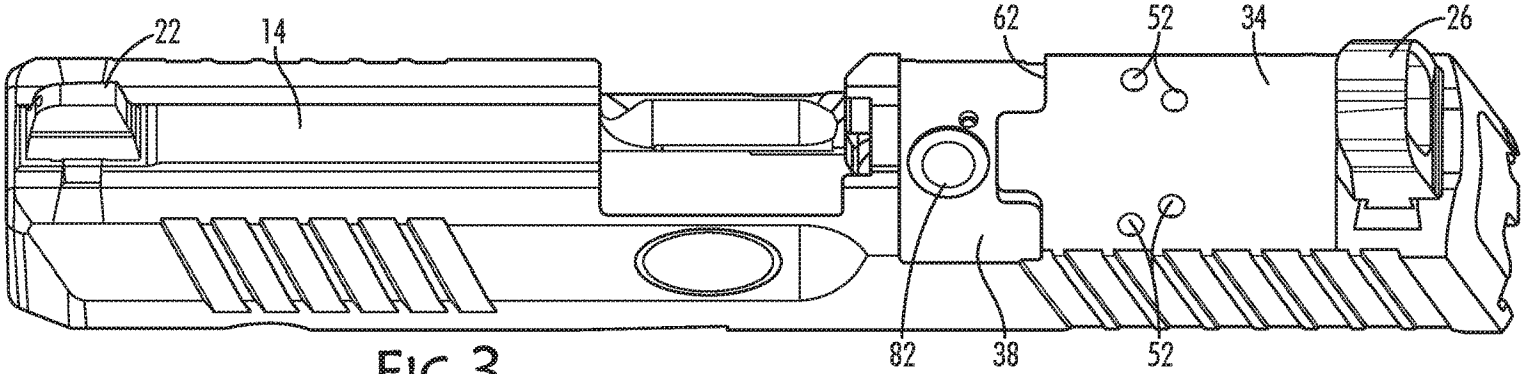
FIG. 3 is an upper left perspective view of the slide shown in FIG. 2 with the adaptor plate removed to show the spring retained by a feature formed in the second portion, according to an aspect of the disclosure.

As seen in FIG. 2 top surface 14 has a first portion 34 and, as seen in FIG. 3, an adjacent second portion 38, which are adjacent portions of top surface 14 of slide 18. Optical sight 30 straddles first portion 34 and second portion 38, as seen in FIG. 1.

A portion of a bottom surface 74 of optical sight 30, as seen in FIG. 1, is attached to top surface 14 of slide 18 at first portion 34 and the remaining part of bottom surface 74 is cantilevered over second portion 38. First portion 34 conforms in shape to the portion of bottom surface 74 of optical sight 30. First portion 34 of top surface has at least one attachment point formed therein and optical sight 30 also has at least one corresponding attachment point formed therein. An attachment point is a location on first portion 34 and a corresponding attachment point is a location on optical sight 30. An attachment point and corresponding attachment point may be alignable, predrilled holes. At least one fastener is used to attach each attachment point in the optical sight to a corresponding attachment point on first portion 34. Optical sight 30 may be attached to first portion 34 using screws 46, for example.

Figure 5:
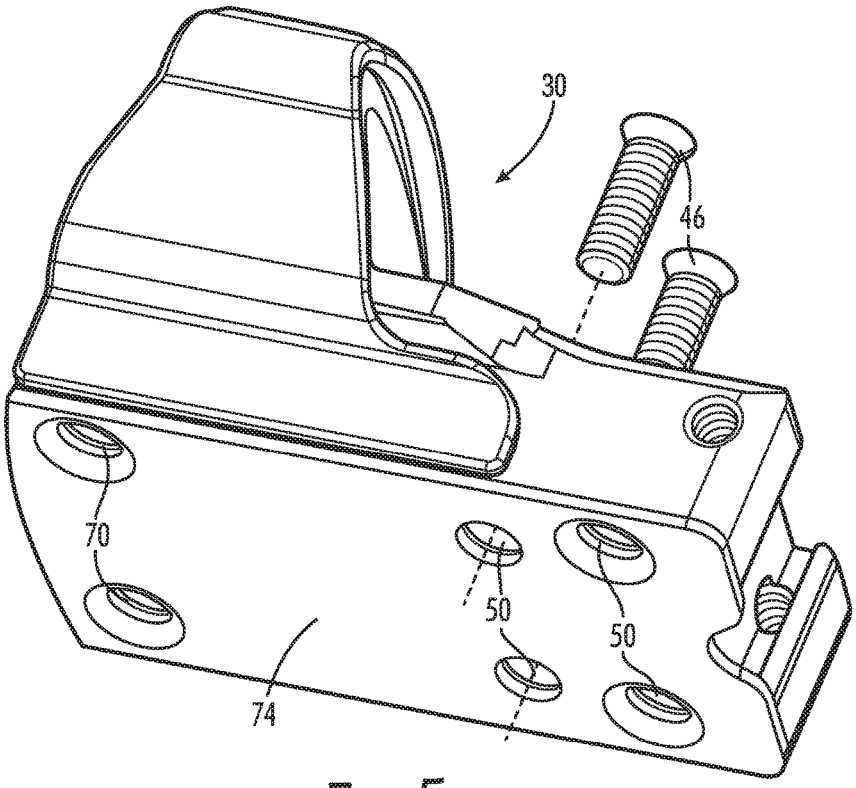
FIG. 5 is a bottom left perspective view of an optical sight showing its topographical features and attachment points.

As best seen by comparing FIG. 2 or FIG. 3 with FIG. 5, two screws 46 are inserted into two predrilled and tapped screw holes 54 in optical sight 30 (FIG. 5) that align with pre-drilled and tapped threaded holes 50 formed in first portion 34 (FIG. 2 or 3) to receive screws 46. Screws 46 do not pass into or through second portion 38.

Several corresponding attachment points may be formed in first portion. Four holes 50 are shown in FIGS. 2 and 3, some of which or all of which may be used to secure the optical sight 30 selected for attaching optical sight 30 to pistol 10. Different optical sights may have different points of attachment, so some corresponding attachment points may be unused depending on the optical sight 30 selected by the user.

Second portion 38 is stepped down from first portion 34 and has a shape. The word shape refers to the shape of the perimeter of second portion. FIG. 3 shows an example of a shape for second portion 38. The shape acts as a key for receiving and orienting an adaptor plate 58. Step 62 defines the boundary between first portion 34 and second portion 38. Step 62 (seen in FIGS. 1 and 3) has a height that is the difference in elevation between second portion 38 and first portion 34, with second portion 38 being lower than first portion 34, as shown.

Adaptor plate 58 is insertable into second portion 38 in the orientation that enables it to fit with the shape of adaptor plate 58 conforming to the shape of second portion 38. Adaptor plate 58 is selected from a set of adaptor plates 58, all with the same shape as second portion 38, and therefore able to be inserted into second portion 38 in the right orientation.

Figure 4A:
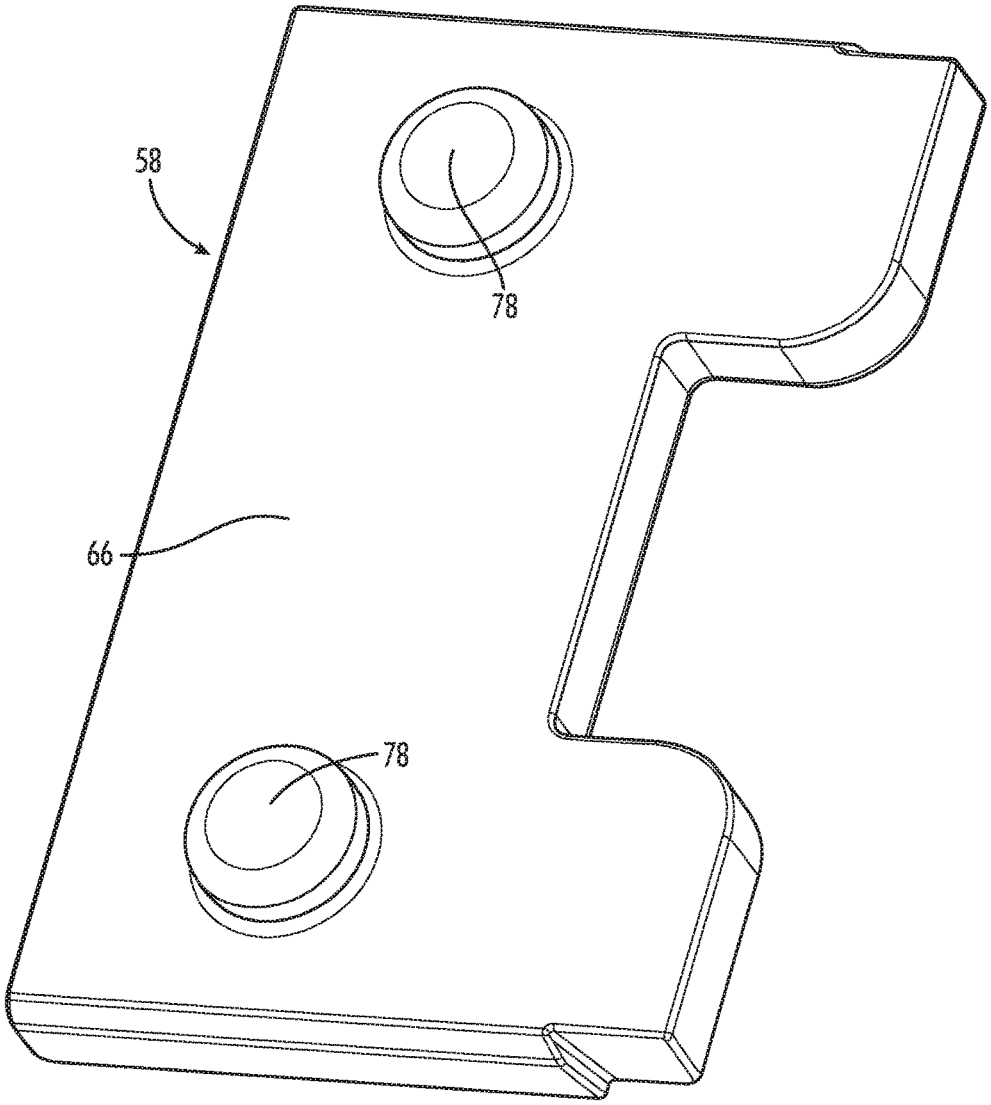
FIGS. 4A, 4B, 4C, and 4D are a perspective top view, a top view, a right side view and a bottom view of the adaptor plate according to an aspect of the disclosure.
Figure 4B:
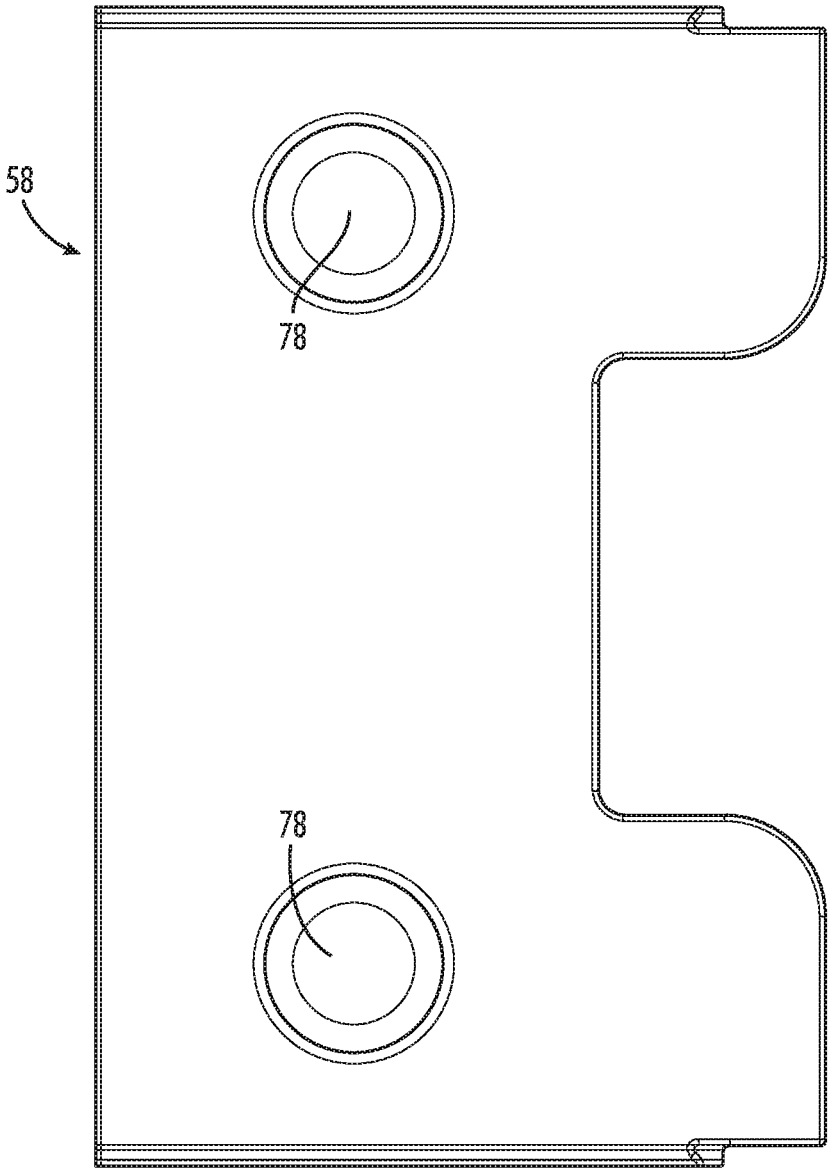
Figure 4C:
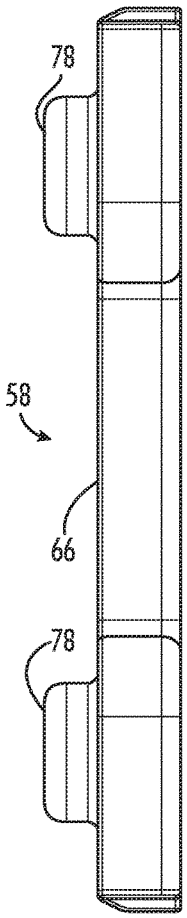
Figure 4D:
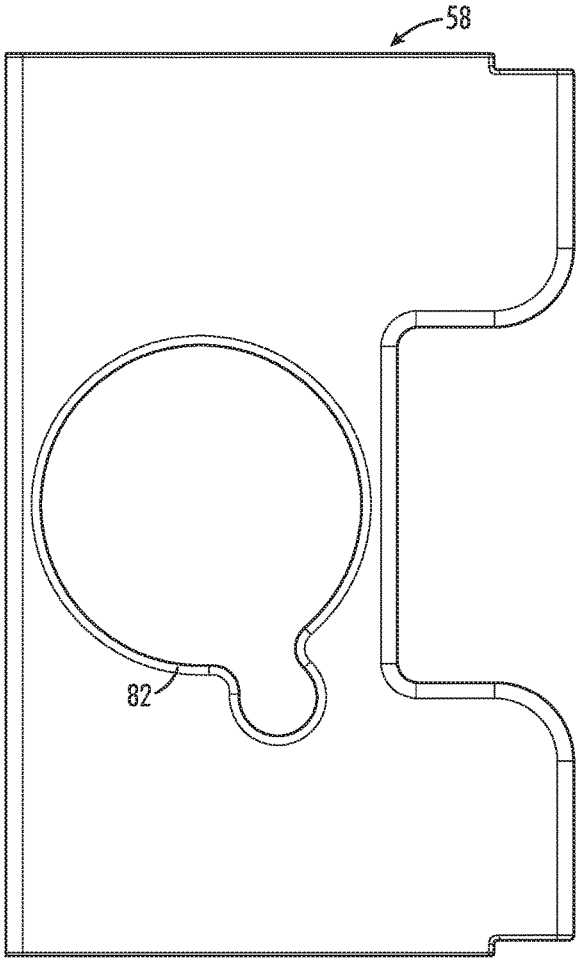

Each adaptor plate 58 has a different topography on its upper surface 66 so that each one is complimentary to a particular optical sight 30. The word topography is used here to indicate features on or in upper surface 66, such as mounting posts 78, best seen in FIGS. 4A, 4B and 4C, which are cylindrical posts. The topography of upper surface 66 of adaptor plate 58 may alternatively have different features than those shown, including having depressions rather than mounting posts 78, and which features are selected and shaped to compliment topographical features on the bottom surface 74 of optical sight 30. The word compliment is used herein to mean that the topographical features on adaptor plate 58 are designed to engage the topographical features on bottom surface 74 of optical sight 30, that is, the topographical features of one mating to the feature of the other so the surfaces adjacent to the topographical features engage. As an example, mounting post 78 on adaptor plate 58 would be received into one or more mounting holes 70 on bottom surface 74 of optical sight 30, so that the positive volume of the mounting post 78 fills the negative volume of mounting holes 70.

Optical sight 30 may have mounting holes 70 formed in its bottom surface 74, as shown in FIG. 5, that compliment mounting posts 78 on adaptor plate 58 so as to enable optical sight 30 to seat onto adaptor plate 58 in the right orientation and not be likely to move laterally from that orientation, but rather remain laterally secured, positioned and oriented on pistol 10.

Adaptor plate 58 has a thickness, which is slightly thinner than the height of step 62 between first portion 34 and second portion 38 in order to accommodate a spring such as an O-ring 82 between second portion 38 and adaptor plate 58. The use of O-ring 82 provides a force counter to the compressive force exerted by the cantilevered part of optical sight 30 on adaptor plate 58 resulting from screws 46 holding optical sight 30 to first portion 34 of top surface 14 of slide 18. It also reduces relative movement of adaptor plate 58 with respect to top surface 14.

Also, the topographies of bottom surface 74 of optical sight 30 and of upper surface 66 of adaptor plate 58, which are complimentary topographies, limit lateral movement of optical sight 30 with respect to adaptor plate 58.

First portion 34, which is part of top surface 14 of slide 18 of pistol 10, may not necessarily be at the same elevation as the rest of top surface 14 but may be lower than other parts of top surface 14 (and higher than second portion 38). Second portion 38 is lower than first portion 34 because of step 62. First portion 34 may be flat, as shown, or curved to fully engage the bottom surface of optical sight 30. Lowering first portion 34 from the elevation of other portions of top surface 14 may enable optical sight 30, when attached to pistol 10, to co-witness with the existing front sight 22 and rear sights 26 of pistol 10.

Those skilled in the art of firearms will appreciate that many substitutions and modifications may be made in the foregoing description and accompanying drawings without departing from the spirit and scope of the present disclosure.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A device, comprising:

(a) a firearm having a top surface with a first portion and a second portion, said first portion and said second portion being defined by a step, said step having a height;

(b) an adaptor plate operable to fit into said second portion of said top surface, said adaptor plate having a thickness not thicker than said height of said step, said adaptor plate having a first configuration comprising at least one mounting feature and defining a topography of the adaptor plate; and (c) an optical sight having a bottom surface and wherein said bottom surface of said optical sight is fastened directly to said first portion of said top surface and extends over said adaptor plate, said adaptor plate being in said second portion, said bottom surface of said optical sight having a second configuration comprising at least one topographical feature which is complementary to the at least one mounting feature such that the at least one topographical feature of the optical sight mates to the at least one mounting feature of the adaptor plate, said adaptor plate being operable to align said optical sight with respect to said top surface of said firearm.

2. The device of claim 1, wherein said first portion of said top surface is larger than said second portion.

3. The device of claim 1, wherein said first portion has at least one attachment point formed therein and said optical sight has at least one corresponding attachment point formed therein, and wherein said device further comprises at least one fastener cooperating with said at least one attachment point on said optical sight and said at least one corresponding attachment point of said top surface of said firearm to fasten said optical sight to said first portion.

4. The device of claim 1, wherein said first portion has at least one attachment point formed therein and said optical sight has at least one corresponding attachment point formed therein, and wherein said device further comprises at least one fastener cooperating with said at least one attachment point and said corresponding attachment point to fasten said optical sight to said first portion of said top surface of said firearm.

5. The device of claim 1, wherein said firearm has a front sight and a rear sight, and wherein said optical sight and said front sight and said rear sight co-witness.

6. The device of claim 1, further comprising a spring located between said second portion and said adaptor plate.

7. The device of claim 1, further comprising a spring, and wherein said adaptor plate has a bottom surface with a feature formed therein and wherein said feature in said bottom surface of said adaptor plate is able to receive said spring.

8. The device of claim 1, further comprising a spring and wherein said second portion has a feature formed therein and wherein said feature of said second portion is operable to receive said spring.

9. The device of claim 1, wherein said second portion of said top surface has a first shape and said adaptor plate has a second shape, and wherein said first shape and said second shape are complimentary shapes.

10. The device of claim 1, wherein the adaptor plate is one of a plurality of interchangeable adapter plates, each having a different first configuration.

11. A device, comprising:

(a) a firearm having a top surface including a first portion and a second portion, said second portion being defined by a step with respect to said first portion, said step having a height, said first portion having at least one attachment point formed therein, and said second portion having a first shape;

(b) an adaptor plate receivable in said second portion of said top surface, said adapter plate having a second shape, said second shape complementary to said first shape of said second portion, said adaptor plate having a first configuration comprising at least one mounting feature and defining a topography of the adaptor plate; and (c) a optical sight having a bottom surface and wherein said bottom surface of said optical sight conforms to and is fastened directly to said first portion of said top surface of said firearm and extends over said adaptor plate in said second portion, said bottom surface of said optical sight having a second configuration comprising at least one topographical feature which is complementary to the at least one mounting feature such that the at least one topographical feature of the optical sight mates to the at least one mounting feature of the adaptor plate, wherein said adaptor plate is operable to align said optical sight with said top surface of said firearm.

12. The device of claim 11, further comprising a spring received between said adaptor plate and said second portion.

13. The firearm of claim 11, wherein said adaptor plate has a thickness and said step has a height, and wherein said thickness of said adaptor plate is less than said height of said step.

14. The firearm of claim 11, wherein said first portion is larger than said second portion.

15. The firearm of claim 11, wherein said first portion conforms to a bottom surface of said optical sight.

16. The firearm of claim 11, wherein said optical sight has at least one attachment point formed therein and said first portion has at least one corresponding attachment point formed therein, and wherein said firearm further comprises at least one fastener received in said at least one attachment point of said optical sight and in said at least one corresponding attachment point formed in said first portion, said at least one fastener affixing said optical sight to said first portion of said top surface of said firearm.

17. The firearm of claim 11, wherein said configuration of said adaptor plate includes at least one mounting feature.

18. The firearm of claim 11, wherein said firearm may have a front sight and a rear sight and wherein said front sight and said rear sight co-witness with the optical sight.

19. The device of claim 11, wherein the adaptor plate is one of a plurality of interchangeable adapter plates, each having a different first configuration.

20. A device, comprising:

(a) a firearm having a top surface with a first portion and a second portion, said first portion and said second portion being defined by a step, said step having a height;

(b) an adaptor plate operable to fit into said second portion of said top surface, said adaptor plate having a thickness not thicker than said height of said step, said adaptor plate having an upper surface with mounting posts disposed thereon; and (c) an optical sight having a bottom surface and wherein said bottom surface of said optical sight is fastened directly to said first portion of said top surface and extends over said adaptor plate, said adaptor plate being in said second portion, said bottom surface of said optical sight having mounting holes complementary to the mounting posts such that receiving the mounting posts into the mounting holes interconnects the adaptor plate to the optical sight for assembly and wherein the arrangement of the mounting posts and mounting holes is configured to align the optical sight with the top surface of said firearm.

* * * * *